United States Patent [19]

Casarini et al.

[11] Patent Number: 4,669,387

[45] Date of Patent: Jun. 2, 1987

[54] MACHINE FOR POSITIONING FIXING ELEMENTS ON PRIOR LAID TRACKS

[75] Inventors: Erio Casarini, Bologna; Über Montermini, Reggio Emilia, both of Italy

[73] Assignees: C.L.F. Cooperative Lavori Ferroviari Soc. Coop. A.R.L.; Starfer Studio Attrezzature Rinnovamento Ferroviario S.R.L., both of Bologna, Italy

[21] Appl. No.: 628,801

[22] Filed: Jul. 9, 1984

[30] Foreign Application Priority Data

Jul. 29, 1983 [IT] Italy ..... 3515 A/83

[51] Int. Cl.[4] ..... E01B 29/24

[52] U.S. Cl. ..... 104/17.2; 29/792; 104/2; 414/505

[58] Field of Search ..... 104/1 R, 2, 17 A; 33/338, 1 Q; 29/701, 783, 785-787, 791-795, 790, 252; 414/222, 272, 285, 505; 198/367; 294/116

[56] References Cited

U.S. PATENT DOCUMENTS

| | | | |
|---|---|---|---|
| 397,849 | 2/1889 | Gates | 414/272 |
| 3,069,761 | 12/1962 | Sommer | 29/252 |
| 3,163,927 | 1/1965 | Brosseit | 29/792 |
| 3,318,630 | 5/1967 | Bryant | 294/116 |
| 3,628,461 | 12/1971 | Plasser et al. | 104/17 R |
| 3,629,583 | 12/1971 | Plasser et al. | 33/338 |
| 3,722,423 | 3/1973 | Plasser et al. | 104/17 R |
| 3,757,939 | 9/1973 | Henig | 209/900 |
| 3,762,333 | 10/1973 | Theurer et al. | 104/7 R |
| 3,802,022 | 4/1974 | Fleming | 414/505 |
| 3,858,292 | 1/1975 | Gudmestad | 29/792 |
| 3,943,858 | 3/1976 | Dieringer et al. | 104/17 R |
| 3,952,665 | 4/1976 | Stewart et al. | 33/1 Q |
| 3,990,154 | 11/1976 | Theurer et al. | 33/338 |
| 4,256,216 | 3/1981 | Winters et al. | 198/367 |
| 4,373,129 | 2/1983 | Sugalski et al. | 29/785 |
| 4,449,289 | 5/1984 | Kindig | 29/792 |
| 4,470,194 | 9/1984 | Cambiaghi et al. | 29/785 |
| 4,479,440 | 10/1984 | Burr et al. | 104/17 A |
| 4,494,463 | 1/1985 | Young et al. | 104/17 A |

FOREIGN PATENT DOCUMENTS

| | | | |
|---|---|---|---|
| 316250 | 1/1972 | U.S.S.R. | 104/17 A |
| 831891 | 5/1981 | U.S.S.R. | 104/2 |

*Primary Examiner*—Robert B. Reeves
*Assistant Examiner*—Donald T. Hajec
*Attorney, Agent, or Firm*—Laff, Whitesel, Conte & Saret

[57] ABSTRACT

The invention is designed to automatically lay or maintain railroad tracks. The machine is positioned on prior laid rails, with fixing elements, such as track bolts, clips, spring washers and nuts in order to lock the rails to plates already integral with supporting ties. Guides direct each type of the elements along at least one specific routing path that commences at a charging area, passes across a vibrator designed to place the elements in predetermined positions, and terminates at a rotary table designed to accept each type of the elements. Assembly stations expel pre-assembled sets of the elements toward magazines which are able to house, in alignment, a plurality of the pre-assembled sets. The positioning machine is a railroad car which is movable on rails carrying a plurality of the magazines. The pre-assembled sets are sent to laying equipment designed to fix them to the plates. The laying equipment is connected to supports that cause the equipment to inch even when the car is constantly moving.

23 Claims, 33 Drawing Figures

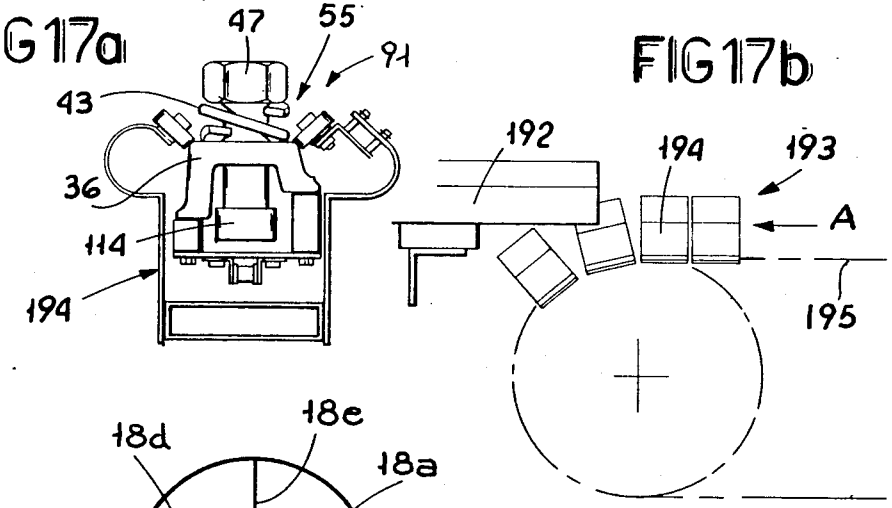
FIG 17b
FIG 17a
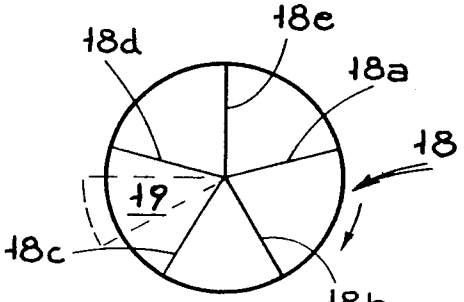
FIG 5
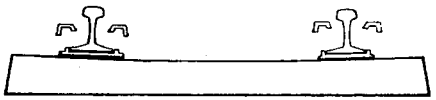
FIG 12
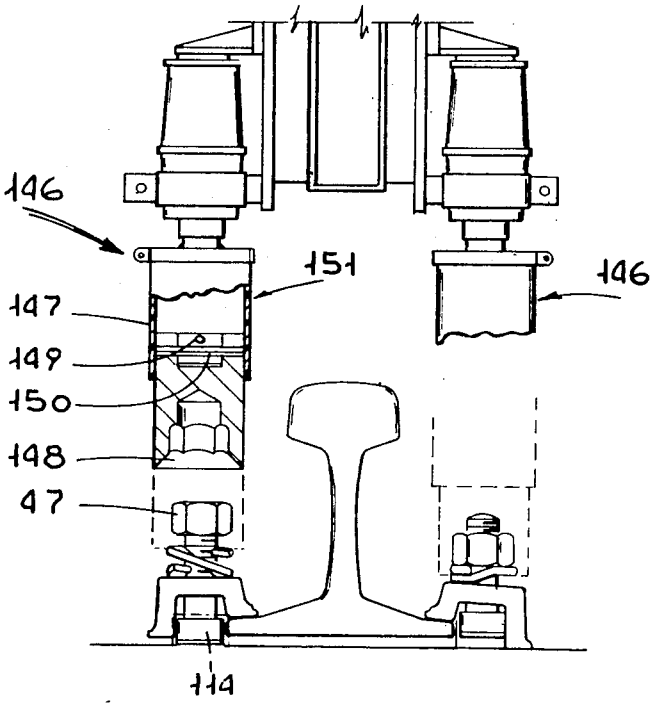
FIG 25

FIG8
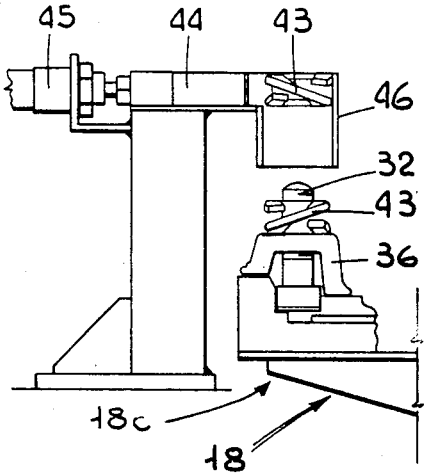
FIG7
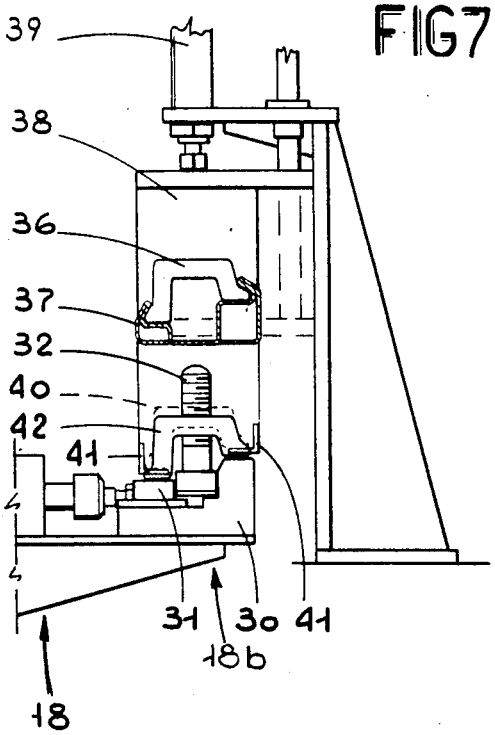
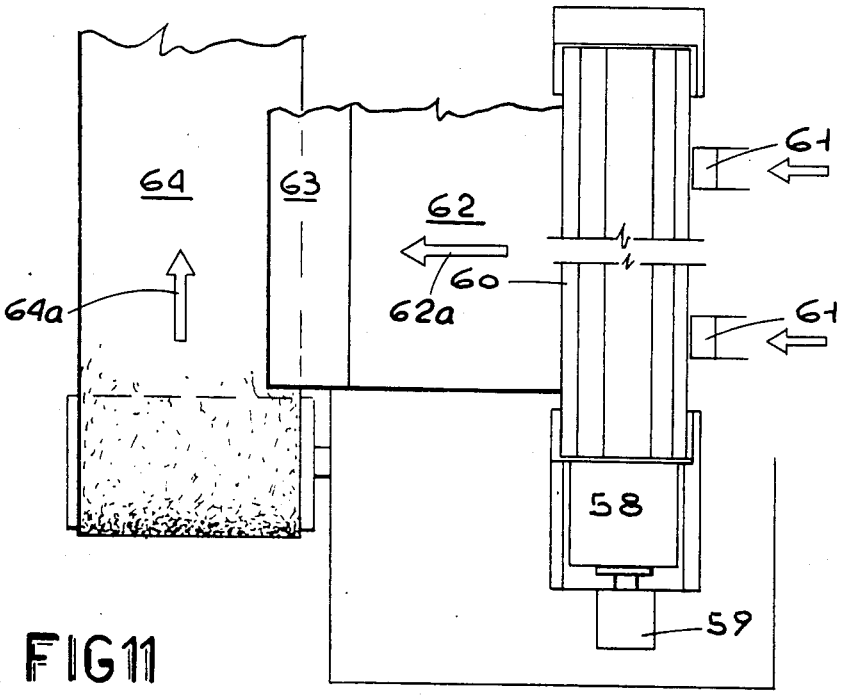
FIG11

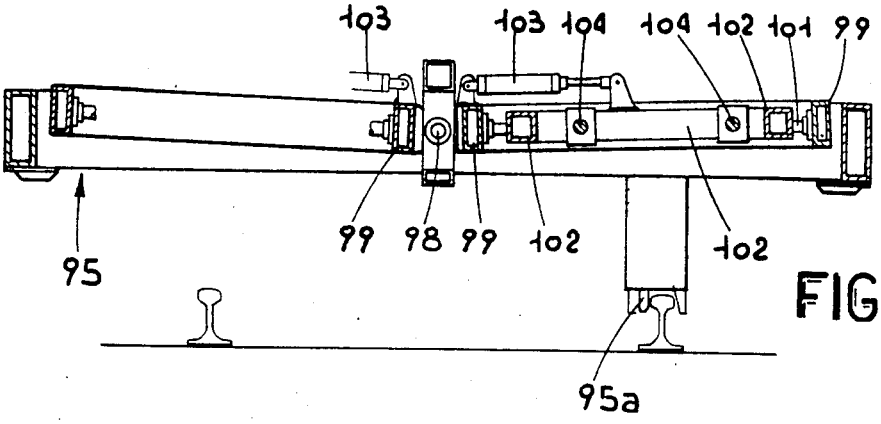
FIG18
FIG19
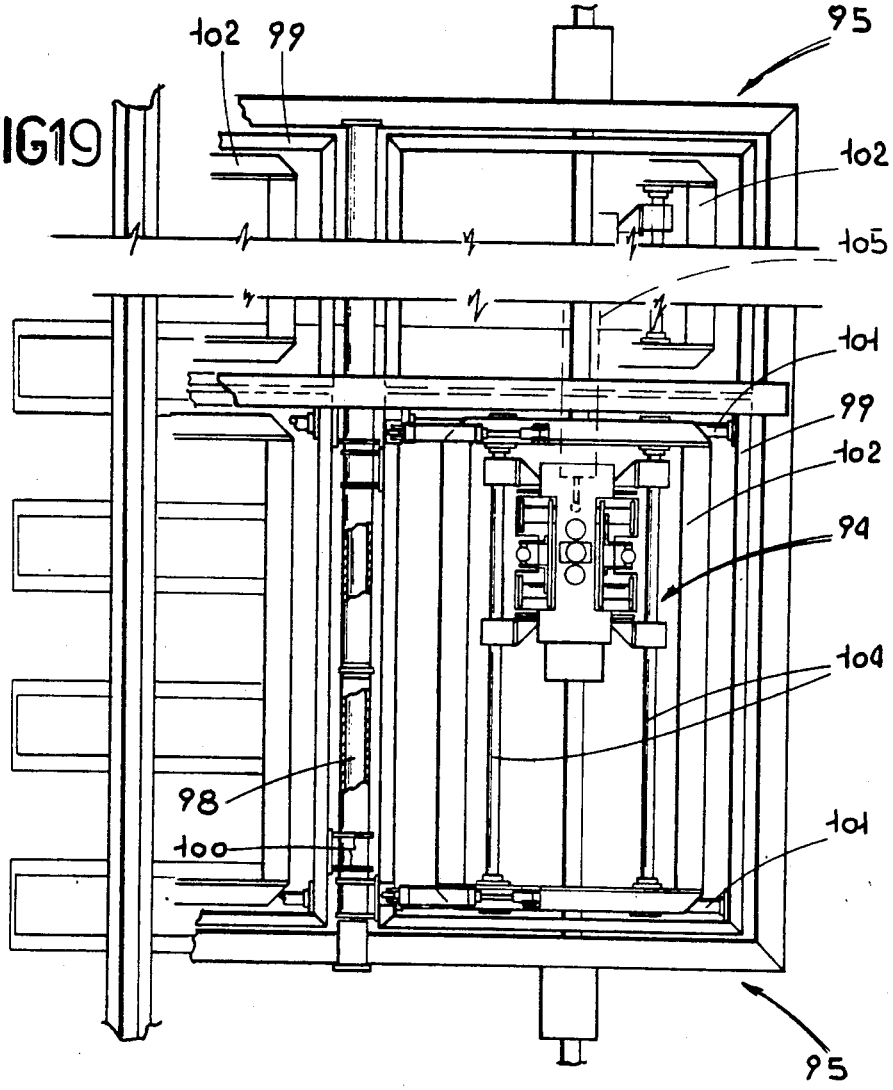

MACHINE FOR POSITIONING FIXING ELEMENTS ON PRIOR LAID TRACKS

BACKGROUND OF THE INVENTION

The invention relates to a machine for positioning fixing elements on prior laid tracks.

DESCRIPTION OF THE PRIOR ART

As is known, track laying operations comprise, among other things, the laying of ties onto specially prepared ballast, the fixing of guide plates to the ties, the positioning of the rails between the plates, resting on the ties, the fitting of track bolts, clips, spring washers and nuts to the plates, the final, precise, setting of the gage of the rails and then the fixing of the tracks by locking the track bolts, clips, spring washers and nuts. A further operation of adjusting the track extension path may then follow.

To a large extent the operations to which brief reference has been made are carried out by using special automatic machines that jointly constitute a track construction train.

One fundamental operation, namely that of locking the rails to the plates already fixed to the ties is, however, still performed in a fully manual way. In order to fix the rails to the plates by means of the track bolt, clip, spring washer and nut, the following operations be effected manually:

item one: preparation in the station of the various sets by manually pre-assembling the track bolt, clip, spring washer and nut;

item two: installation along the line of each pre-assembled set, this being inserted manually into the housing in each plate, with the latter already secured to a tie;

item three: setting of the track gage, this being done manually with hoists or levers;

item four: passing of operators provided with special tools with which to lock the nuts.

After these operations, through the plates the rails are locked to the ties.

For all the operations listed above, a large amount of labour is required at the present time and the number of labors is destined to grow in the future since, overall, the track construction train production rhythm tends to keep on increasing on account of the incorporation of new, evermore perfected, machines used in the excecution of other operations.

Thus the track locking operation is tending to become the bottleneck of the whole track construction train since it is the one that most slows output; also because of the need for a large amount of labour, it is one of the most costly operations.

SUMMARY OF THE INVENTION

The technical task placed at the basis of the invention is to remedy the situation through the creation of a machine that is able to effect the operations of locking the rails in a way that is fully automatic and thus able to raise the working rhythm of the track construction train and to reduce the costs thereof.

Within the framework of the technical task, one important object of the invention is to devise a machine, on one hand complete and capable of effecting every one of the preparatory operations, namely the pre-assembly, the installation and fixing of track bolts, clips, spring washers and nuts, as well as the operations of setting the track gage, and on the other, easily adaptable to the most limited requirements and, for example, to the choice of automating only partially the said operations.

A further important object of the invention is to devise a machine that can easily be subdivided, when the necessity arises, into a number of groups or machines active one separately from the other.

Yet another object of the invention is to devise a machine which, despite the complexity of the operations to be performed and the precision with which the operations have to be effected, is able to offer maximum guarantees of satisfactory operation and longevity.

The technical task and the objects stated, as well as others that will become more apparent hereinafter, are attained with the machine according to the invention for positioning on prior laid rails, fixing elements, particularly track bolts, clips, spring washers and nuts, able to lock the rails to plates already integral with supporting ties, wherein there are at least: guide means for directing each type of the elements along at least one specific routing path that commences at a charging area, passes across a vibrator designed to place the elements in predetermined positions, and terminates at a rotary table designed to accept each type of the elements and provided with assembly stations and means for expelling pre-assembled sets of the elements towards magazines which are able to house, in alignment, a plurality of the pre-assembled sets.

Furthermore, the machine, advantageously is designed to place in position the pre-assembled sets, each of which consists of a track bolt, a clip, a spring washer and a nut, and to lock the tracks to plates already integral with supporting ties. A car which is movable on the rails carries a store which is able to contain a plurality of magazines, each of which capable of housing a plurality of the pre-assembled sets. The sets are taken from the store and supplied to laying equipment designed to fix the sets to the plates. The laying equipment is connected to support means that cause the said equipment to inch along even when the car is constantly moving. The machine has grippers designed to define at least the minimum distance to be fixed between the rails, placed downstream of the laying equipment, and with devices able to tighten each of the pre-assembled sets, being placed downstream of the grippers.

BRIEF DESCRIPTION OF THE DRAWINGS

Further characteristics and advantages of the machine according to the invention for positioning fixing elements will become more apparent from the following description of one preferred, but not sole embodiment, illustrated purely as an unlimited example on the accompanying drawings, in which:

FIG. 5 is a diagrammatic plan view of a rotary table, in an isolated position;

FIG. 7 shows another part of the rotary table in FIG. 5, in the region of a second assembly station;

FIG. 8 shows a certain assembly station of the rotary table in FIG. 5;

FIG. 11 shows, diagrammatically in a plan view, some of the parts illustrated in FIG. 10;

FIG. 12 shows how the clips have to be positioned in the region of the rails;

FIG. 17 shows the means for supplying pre-assembled sets, each constituted by a track bolt, a clip, a spring washer and a nut wherein FIG. 17*a* is rotated by 90° relative to FIG. 17*b*, being taken in direction A;

FIGS. 18 and 19 show in a front view and in a plan view, respectively, the means supporting the laying equipment of the pre-assembled sets;

FIG. 25 shows how the devices for tightening the pre-assembled sets operate, as well as the final assembled structure of a track in the "locked" position.

DESCRIPTION OF THE PREFERRED EMBODIMENT

Figure 1A:
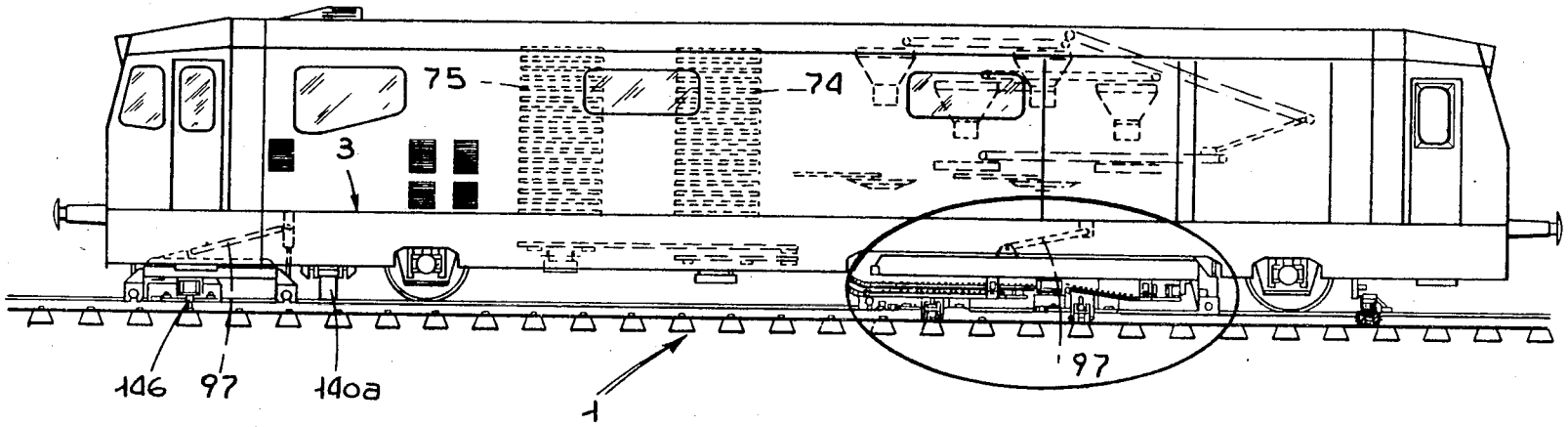
FIG. 1 shows, in an overall view and in a partial transparency, the machine in question.
Figure 1B:
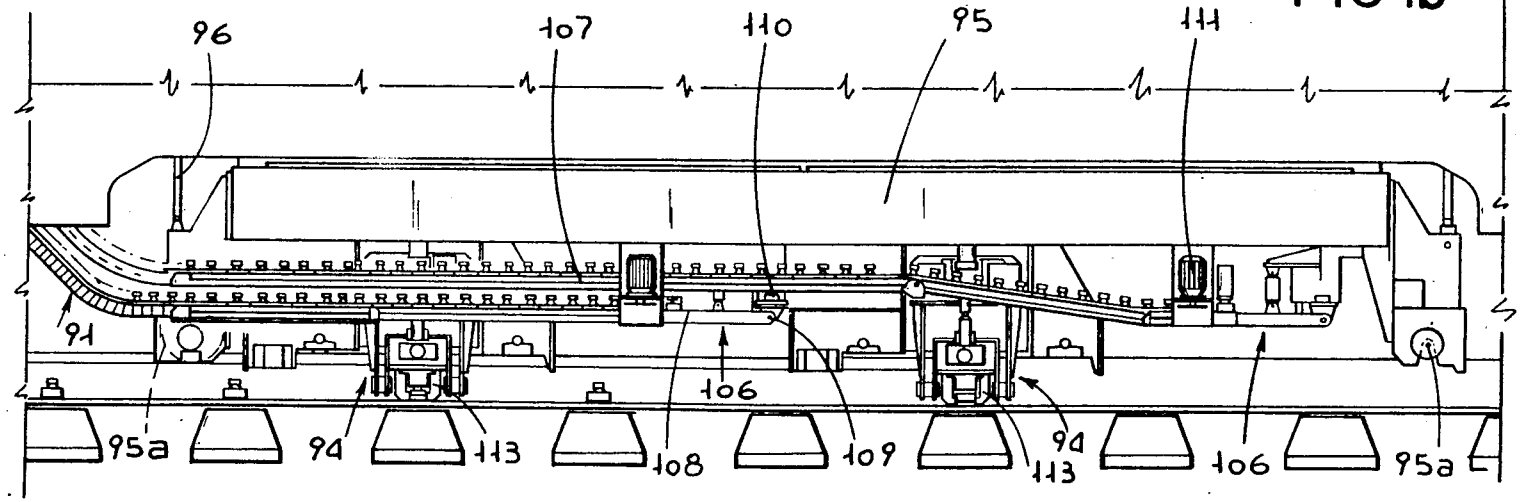

With reference to the above listed figures, the machine according to the invention is shown globally at 1 in FIG. 1.

The machine 1 is subdivided into a number of sections, each of which carries out one particular work phase, such as the preparation of the sets, the pre-assembly in the station of the various parts, the placing of the sets in a suitable store, and the fixing in line of the sets, with the contemporaneous track gaging operation.

The first work phase is the formation of pre-assembled sets of track fixing elements, that is to say, track bolts, clips, spring washers and nuts.

In order to form the said pre-assembled sets, it is necessary for the machine 1 to receive the various elements in a precise and constant order. The way in which the various elements are currently supplied is as follows: the track bolts in sacks; the clips in batches of 25, all oriented in the same direction and kept together by an iron wire passed through holes therein; the spring washers in sacks; and the nuts which are also in sacks.

The elements, supplied in this way, are sited in the region of a belt conveyor 2 placed at the side of the machine 1. The belt conveyor 2 is provided with paddles so that it be able, in view of the roughly 45° inclination thereof, to raise the elements.

In the non-operating position, the belt conveyor 2 is housed inside the machine 1, raised with respect to the base surface 3 of the machine 1. This position is shown with broken lines in FIGS. 2 and 3.

At the time of use, in the station during the pre-assembly phase, the belt 2 is made to rotate around a fulcrum 4 and, through a carriage 6, to slide on a guide track 5. The rotation carries the belt 2 into the position shown in FIG. 3. Then, by means of a hydraulic cylinder 7 (FIG. 2), the belt 2 is lowered into the working position where the various elements are received in the way in which they are supplied.

The various elements are rested, still as supplied, on a work surface placed at the base of the belt conveyor 2 and are then freed from the containment means and are discharged onto the belt 2.

Figure 2:
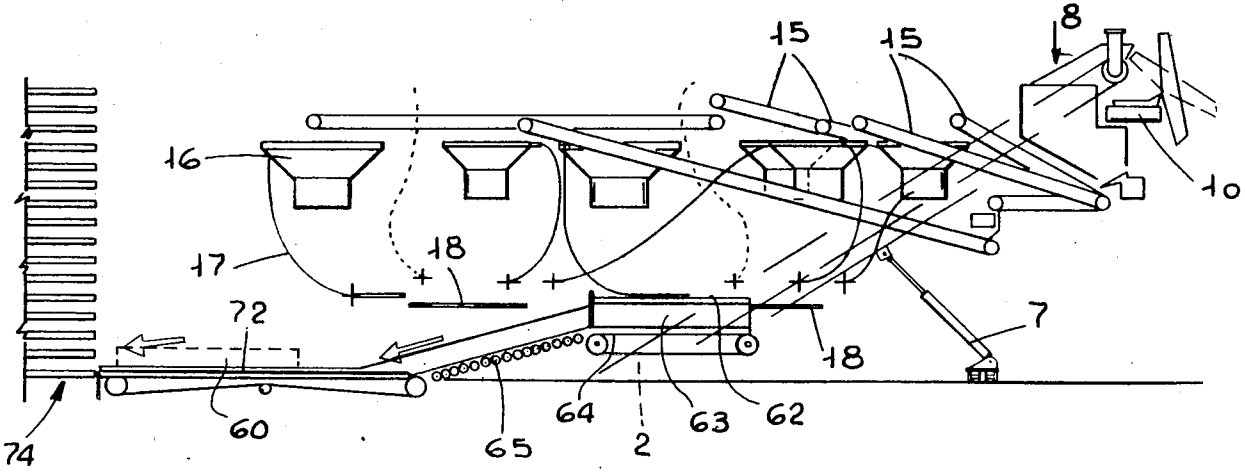
FIG. 2 shows, in longitudinal sectional form, part of the view in FIG. 1.
Figure 3:
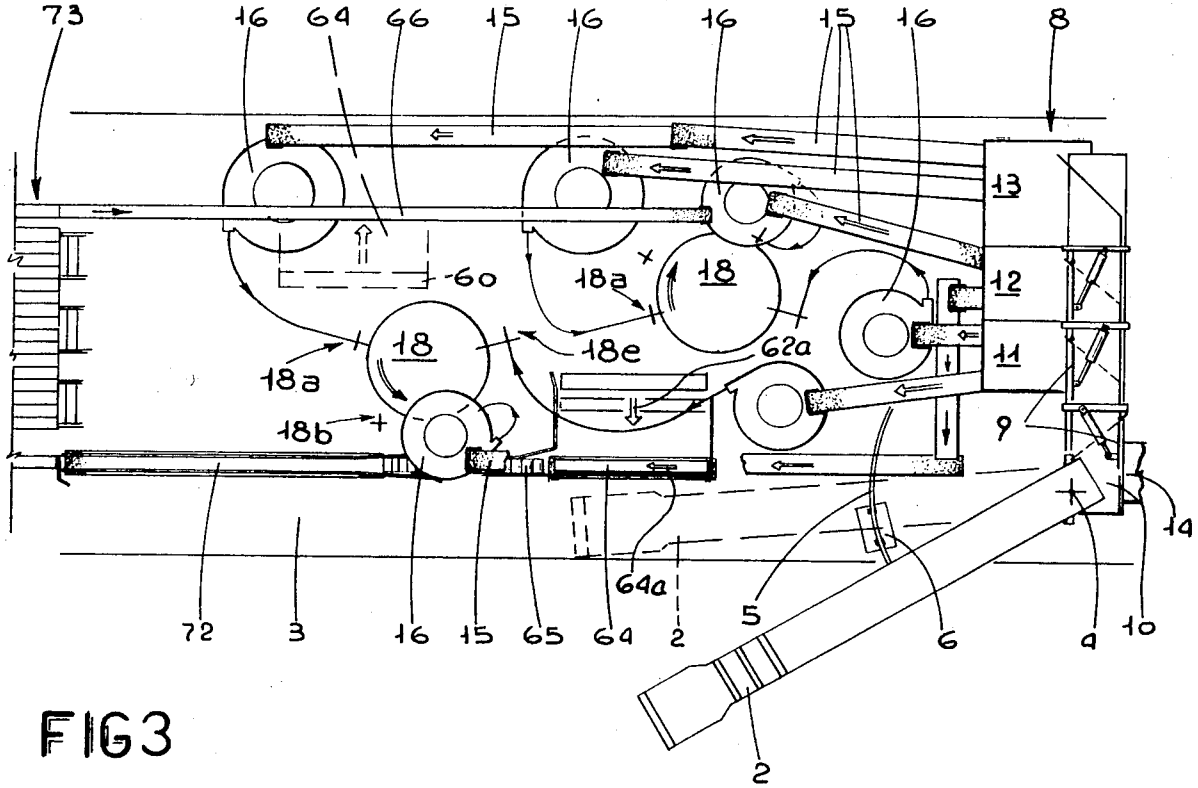
FIG. 3 is a plan view of FIG. 2.

As shown in FIGS. 2 and 3, the belt conveyor 2 carries the elements, namely the track bolts, the clips, the spring washers and the nuts, to hoppers 8, separated by baffle plates 9 that can be positioned through control means placed at the base of the belt conveyor 2 and are able to direct the various elements according to type.

The baffle plates 9 are three in number, the task of which is to discharge the various elements from a belt 10, directly adjacent to the upper extremity of the belt conveyor 2, to a first hopper 11 for the nuts, to a second hopper 12 for the spring washers, to a third hopper 13 for the track bolts and to a fourth hopper 14 for the clips. The fourth hopper 14 is contiguous to an additional transportation system that extends overhead of the hoppers.

In detail, the track bolts are discharged from the belt conveyor 2 onto the belt 10 while all the baffle plates 9 are closed in such a way as to define lateral walls. The track bolts then go forward to the end of the belt 10 from which, in view of the shape of the lateral wall of this, they are made to drop inside the third hopper 13 which, in common with the others, has a vibrating base wall. The hopper allows the track bolts to fall onto two conveyors 15 by which they are carried to first vibrators 16. From the first vibrators, the track bolts pass along guides 17.

The paths followed by the nuts and by the spring washers are similar to what has been described above, the only variation being that they require the corresponding baffle plates 9 to be opened. In each case every one of the elements has a specific routing path and special guide means with corresponding vibrators.

It should be noted in the preferred embodiment, the clips follow a path that is raised as compared with the path of all the other elements. Furthermore, for the clips four conveyors are provided to supply four vibrators. The choice of four vibrators for the clips is because of the considerable weight of each individual clip, the output of the vibrators does not exceed 300 pieces/-hour. This brings about the necessity to unite the individual output of two vibrators into one single track so as to maintain the production rhythm of the vibrators that position the other elements.

A step that has been found opportune is that of providing each vibrator 16 with a level indicator so as to render the output optimal and to keep unvaried the number of pieces in each vibrator, as well as to be able to halt the supply should there be an excess.

Furthermore, it has been found opportune to place on the outgoing tracks of the vibrators 16, instruments which are able to check whether the tracks are full, and if so to slow down or halt the working cycles of the vibrators, all of which are soundproofed to prevent excessive noise.

As shown in outline in FIG. 1 and directly in FIG. 2, all the mechanical parts described are placed in the machine 1 above the surface 3, and from a sheet metal platform of the type on which one can stand, a check on the whole area is ensured.

Figure 6:
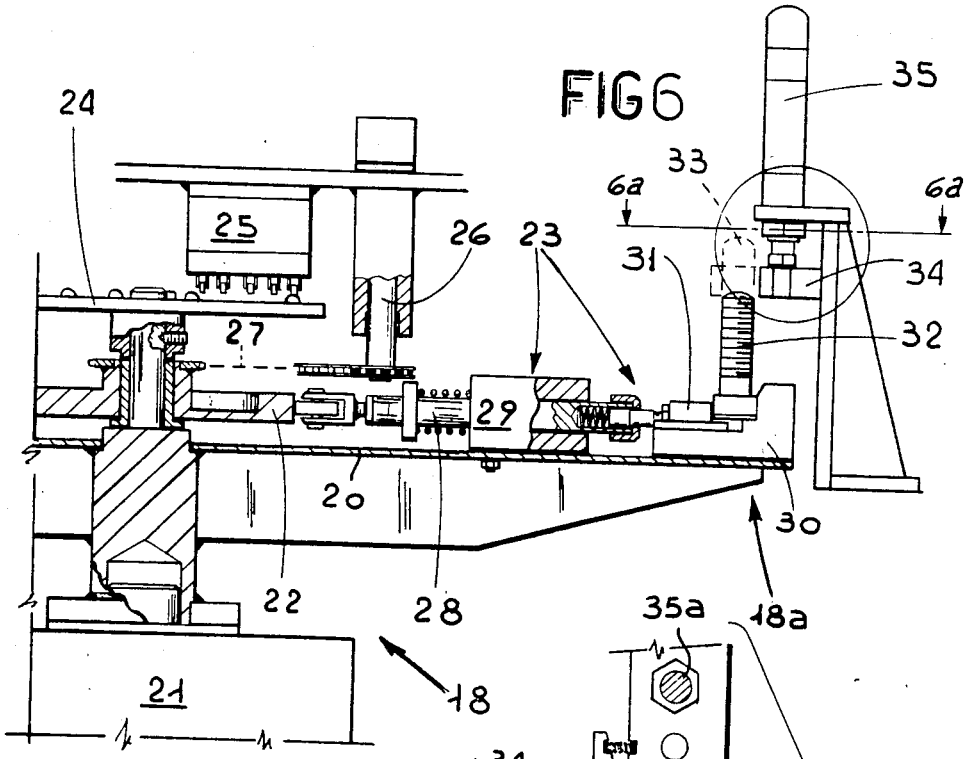
FIG. 6 shows, in an elevation and in partial sectional form, the rotary table in FIG. 5, in the region of a first assembly station.
Figure 6A:
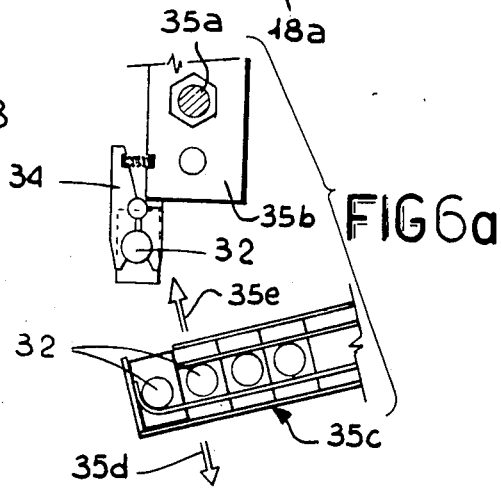
FIG. 6*a* is a fragment taken from FIG. 6 along line VI—VI and showing an enlargement of a gripper.

The routing paths of the said elements, extending from the charging area in the region of the belt conveyor 2 and passing through the vibrators 16, terminate at rotary tables 18 designed to accept each type of the elements, shown in detail in FIGS. 5 and 6.

The operating principle of the rotary tables 18 is as follows: thanks to a plurality of assembly stations, with each halt of the said rotary tables one assembly operation has to be performed. Thus at the end of the first revolution, one pre-assembled set is expelled after each part revolution.

Four assembly stations are provided and, as shown diagrammatically in FIG. 5, at a fifth station there are means for expelling the pre-assembled sets.

The movement of the rotary tables 18 is through a "roto-blok" unit that converts uniform rotary motion into reciprocating motion: each full input revolution generates only one fifth of an output revolution.

In general, for each rotary table 18, there are five halts: at the first 18*a* the rotary table 18 takes a track bolt, at the second 18*b* it puts a clip on the track bolt, at the third 18*c* a spring washer is threaded onto the track bolt, at the fourth 18*d* a nut is put on and screwed for only two leads of the thread and, lastly, at the fifth halt 18*e* the pre-assembled set is expelled. Thus the cycle is complete and at every fifth of a revolution, one complete pre-assembled set is able to pass out.

Again in general, it should be noted that, as is shown in FIG. 5, between the third halt 18*c* and the fourth halt 18*d* an axiliary station 19 is provided, and in the region of this a piece of tape, or resin or wax, is inserted on the shank of the track bolt in order to restrict any possibility of the nut, fitted at the fourth halt 18*d* and screwed for only two leads of the thread, accidentally unscrewing.

In greater detail, as can be seen in FIG. 6, the rotary table 18 comprises a sheet metal top 20 connected to and centered on the shaft of the "roto-blok" unit, shown at 21. Positioned on the shaft are two cams, the first of which, 22, is only centered on the shaft and rotates independently of the rotation of the rotary table 18. This first cam 22 attends both to the closing and to the opening of the grippers 23 that lock the various elements, more about which will be said hereinafter.

The second cam, 24, rotates instead with the whole rotary table 18 and, at programmed intervals, sets in rotation, through microswitches 25, a shaft 26 which, through a chain 27, moves the first cam 22. The latter is so shaped as to be able to close the various elements right from the first halt 18*a*, and to free them in the region of the fifth halt 18*e* of the rotary table 18.

Double cam control is necessary since the opening and closing of the locking grippers 23 is effected when the whole rotary table 18 is already immobile. Therefore, the movement of the rotary table cannot be utilized to bring about the opening and closing of the locking grippers 23. The first cam 22 returns to the waiting position at the time the rotary table starts moving and repeats the cycle at each halt.

The locking grippers 23 are shown in FIG. 6 and they are five in number, one for each halt, each constituted by a control shaft 28 moved by the first cam 22, a support 29 for the shaft 28, a stationary counter gripper 30, and by a movable gripper 31 fixed to the control shaft 28.

In the region of the first halt 18*a* (FIG. 6), the corresponding locking grippers 23 close onto a track bolt 32 that is supplied via an end part of the guide means defined by a track which is able to be oscillated angularly in order to prevent interference problems. The track carries the track bolts into position 33 in FIG. 6 and in so doing inserts them into spring grippers 34. The track then rotates through approximately 15°, moving away from the spring grippers 34, while the track bolt 32, gripped by the latter, is made to move downwards under the control of a pneumatic cylinder 35. Thus the track bolt 32 comes to rest on the stationary counter gripper 30 and straight away the movable gripper 31 locks onto the element. This having been done, the spring grippers 34 return upwards, withdrawing from the vice held track bolt, under the control of the pneumatic cylinder 35 in order to prepare for a fresh cycle.

The rotary table 18 now undergoes a fifth of a revolution carrying the locking grippers 23, with the track bolt 32, into the region of the second halt 18*b*.

With reference now to FIG. 7, at the halt the clips 36, arrive along a specially provided track 37. A limit position, in contrast with a spring element, is provided on the track and this can be exceeded only under the control of a purposely provided pneumatic cylinder at the commencement of the supply cycle. When the cycle begins, the pneumatic cylinder pushes the last clip 36 on the track 37 forward past the track and then returns to the previous position for a new cycle. The displaced clip is placed resting on lateral guides fixed to a support 38 which is able to move downwards under the control of a purposely provided pneumatic cylinder 39, until the clip is carried into the position shown at 40. When in this position, the clip is already centered on the thread of the track bolt 32. The rotation then commences of the rotary table 18 and this withdraws the clips from the lateral guides, shown at 41, causing the clips to adopt the position shown at 42. In practice, the clips withdrawn from the lateral guides 41 drop by gravity and come to rest on the stationary counter gripper 30 and the movable gripper 31.

Spring washers 43 are fitted during the halt of the rotary table 18, indicated with 18*c* in FIG. 8. The washers arrive along a special track 44 and are thrust, one at a time, into the supply position by a purposely provided pneumatic cylinder 45. Merely by gravity, the spring washers 43 drop onto the clip 36 and are thread onto a track bolt 32. A cylindrical guide section 46 can be provided in order to prevent the wrong positioning of the spring washers 43.

The rotary table 18 then rotates a further fifth of a revolution in order to arrive at the fourth halt 18*d*. During this displacement, the set formed passes in the region of the auxiliary station 19, thanks to which a piece of tape is placed on the thread of the track bolt 32. Alternatively, resin or wax is sprayed. This is done to prevent the nut which is to be fitted from becoming unscrewed prior to installation.

It should be noted that assembly exigencies require the nut to be screwed for only two leads or turns of the thread.

Figure 9:
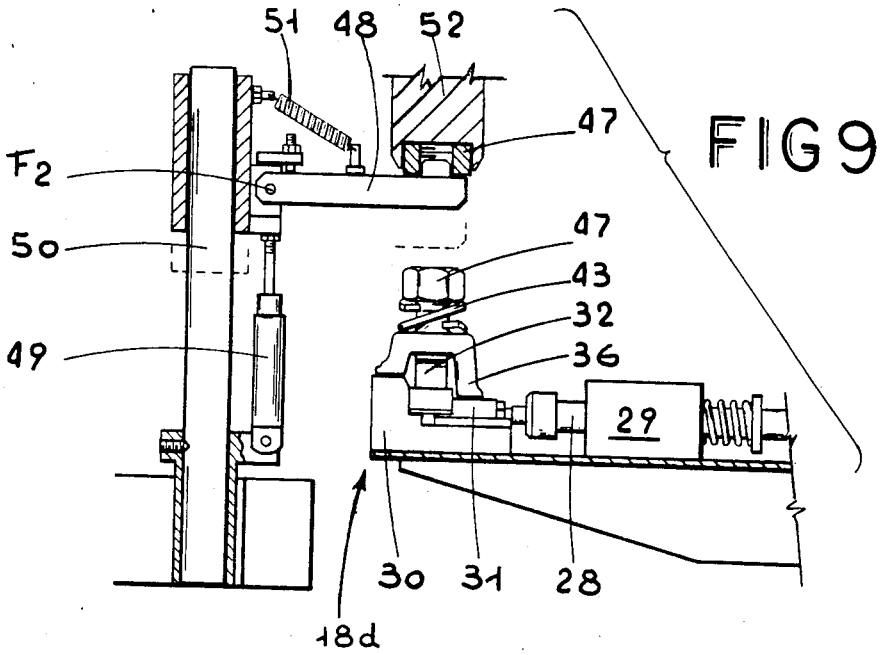
FIG. 9 shows a fourth assembly station located in the region of the rotary table in FIG. 5.

At the fourth halt 18*d* (FIG. 9), the nuts 47 arrive along a special track on which they come to a standstill at a point where a limit position is defined by an elastic blade shaped element. An arm located in a position beneath the guide, shown at 48, rises under the control of a pneumatic cylinder 49 and engages one of the nuts. It then rotates around a shaft 50, withdraws the engaged nut from the guide and completes a 90° rotation that carries it into a lowered position. This is because, during the rotation, it slides on a cam that determines the lowering movement, while upon completion of the rotation, the arm is returned to a raised position by a spring 51 that carries it so that the nut 47 are inserted in a tightening device 52. The mouth of the device 52 has a spiral profile so as to allow, during the ascent of the nut 47, the correct orientation of the gripping sides. The head of the tightening device 52 has to be magnetic, in such a way as to keep a hold on the nut 47 and not let it drop.

Once the nut 47 is inserted in the head of the device 52, the cylinder 49 returns the arm 48 to the lowered position in such a way as to get all the elements ready for a further cycle.

Meanwhile, the tightening device 52 starts rotating and descending towards the underneath or bottom track bolt 32. The rotation is controlled by a self-braking geared motor whose disengagement is determined by the screwing depth it is wished to reach. Once a limit control operates, the complete rotating group of the tigthening device 52 has to come to a standstill in the shortest possible space of time, for example in one tenth of a revolution. The limit control also causes the complete group of the device 52 to return upwards in preparation for a fresh cycle.

The rotary table 18 then rotates a further fifth of a revolution and carries the various assembled elements into the region of the fifth halt 18*e*. At this (see FIGS. 10 and 11) operate means for expelling the already pre-assembled sets, formed by the track bolt 32, the clip 36, the spring washer 43 and the nut 47, the latter only slightly screwed onto the track bolt 32 in contrast with the washer 43.

The encircled drawing (FIG. 10*a*) is an enlarged view of the jaw type grippers 53. The expulsion means comprise jaw type grippers 53 (FIG. 10*a*) operated by a pneumatic cylinder 54 which is able to cause the jaw type grippers 53 to descend until the lateral parts of the clip 36 are grasped. The structure of the jaw type grippers 53 is shown, in a detailed and isolated view, in FIG. 10*a*.

Operation wise, the grippers 53 move downwards, grasp the clip 36 through the natural expansion of the jaws thereof that open and reclose under the sides of the clip, and then return upwards under the control of the pneumatic cylinder 54, carrying with them the pre-assembled set. In the meantime, obviously, the corresponding locking grippers 23 have disengaged the track bolt 32, in such a way as to allow the pre-assembled set, shown globally at 55, to be uplifted. Once raised, the pre-assembled set 55 is displaced in a horizontal direction thanks to the presence of guides 56 engaging with the unit formed by the pneumatic cylinder 54 and the jaw type grippers 53. The horizontal movement is controlled by a further pneumatic cylinder 57.

Figures 10, 10A, 10B:
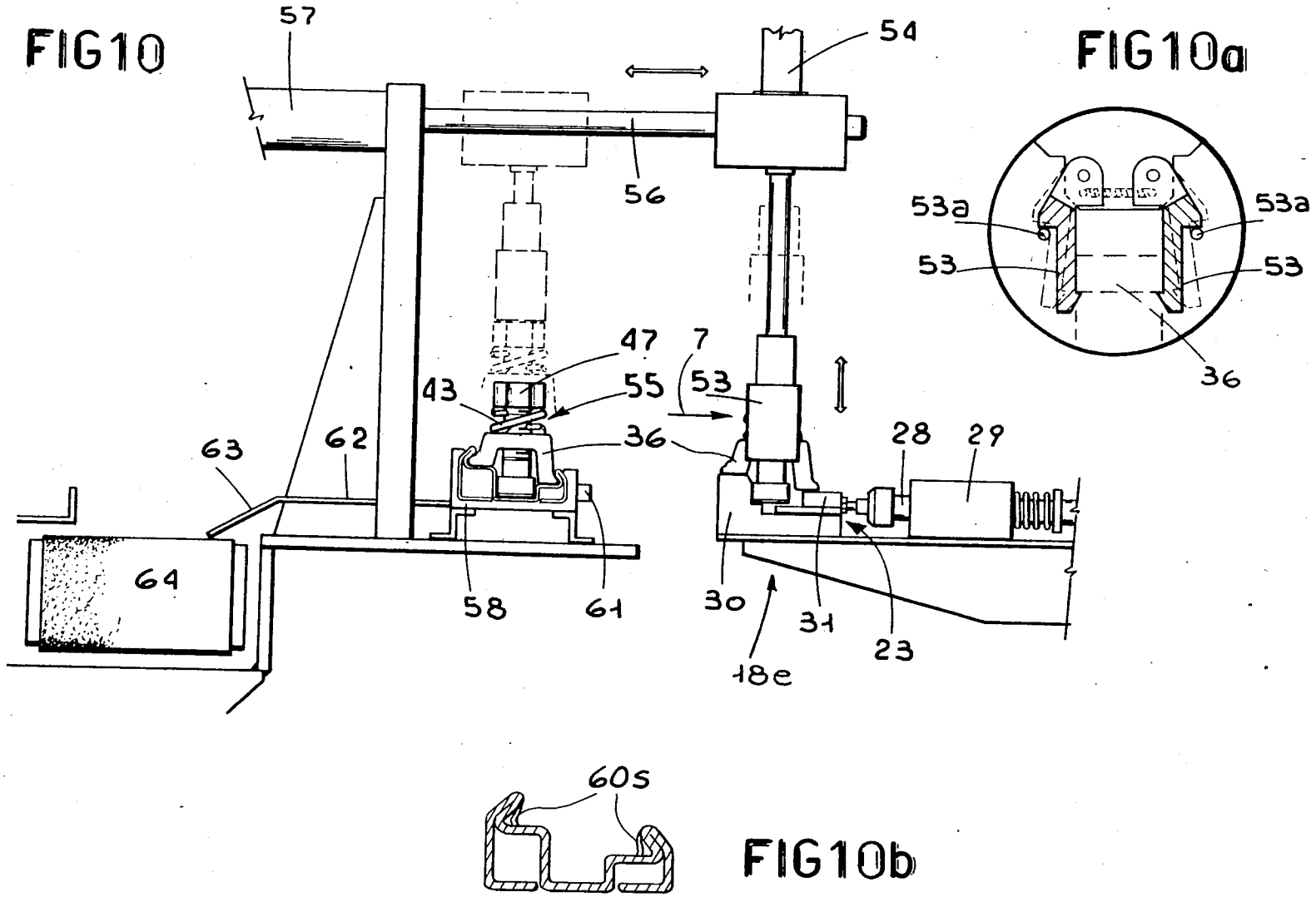
FIG. 10 shows means for expelling pre-assembled sets from the rotary table in FIG. 5.
FIG. 10*a* is an enlarged showing of a gripper seen in FIG. 10.
FIG. 10*b* is a section of a magazine showing springs use therein.
Figure 13B:
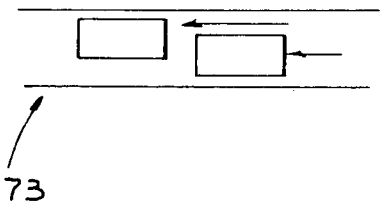
FIGS. 13*a* and 13*b* show, diagrammatically, in an elevation and in a plan view, respectively, how the parts of the store provided in the machine according to the invention are arranged.
Figure 13A:
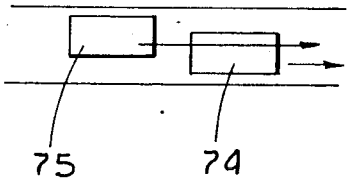

FIG. 10*b* shows springs 60*s* which are able to restrain the pre-assembled sets. These springs are associated with magazines which have a cut-out section, partially in the shape of the pre-assembled sets.

When the position shown in dashes in FIG. 10 is reached, the means cause the pre-assembled set 55 to move downwards, and the descent continues on the part of the jaw type grippers 53 until they engage with locator members 53*a*, shown diagrammatically in the detail depicted in FIG. 10*a*. These determine the opening of the arms of the jaw type grippers 53. Therefore, the complete pre-assembled set 55 drops by gravity onto a table 58 partially in the shape of the pre-assembled set 55, to which particular emphasis is given in FIG. 11. From here, while the pneumatic cylinders 57 and 54 carry the jaw type grippers 53 to commencing a fresh cycle, the pre-assembled set 55 is pushed, by a further pneumatic cylinder 59, into inside a magazine 60 that represents the principal element for supporting the pre-assembled sets 55 and for forming a store for the said sets.

In FIG. 10*b* the cross hatched section refers to the magazine 60.

The part of the positioning machine described above in both a structural and a functional sense constitutes the part of the machine that attends, in a fully automated fashion, to the pre-assembly of the elements destined to fix the tracks. Therefore, the part of the machine can, in the case of need, be separate from the remainder of the machine described below.

The eventual separation leads to the formation of two distinct machines, one for pre-assembling the fixing elements, the other for installing the elements and, in view of the strict continuity of work existing between the two machines it can, therefore, result in global cost increases and structural complications, as well as a need for special automated link-up means between the two parts of the machine. However, separation can be opportune when it is decided to use prevalently only one of the two parts of the machine for any practical need. From this viewpoint it should be considered that the pre-assembly of the elements destined to fix the tracks can take place in the station, or at any rate in a state of immobility, so as not to interfere, through oscillations and movements, with the operation of the vibrators. Vice versa, the laying of the pre-assembled sets obviously has to take place while the machine moves forward on the rails.

The preferred technical solution remains, however, that shown in FIG. 1, with the part of the machine destined for the pre-assembly of the fixing elements, closely united and cooperating, on a movable car, with the part described below, destined to lay the pre-assembled sets.

The car constituting the machine in the entirety thereof has, as can be seen in FIG. 1, a double cabin, one for each extremity, in order to allow movement in both directions, otherwise hampered by ample intermediate hoods. One of the cabins is fully equipped, in other words provided with all the drive mechanism, while the other has preferably only operating controls. Furthermore, it is preferred that the car be provided with hydrostatic transmission so as to advantageously dispense with mechanical transmission and particularly cumbersome gears.

The machine can advantageously also be provided with a fixed system for placing the frame flat when in the station, during the pre-assembly phase of the elements destined to fix the tracks.

The device can consist of four hydraulic cylinders that rest on the axles (with a suitable plastic material saddle) inside the wheels.

The technical solution of uniting in one and the same machine the means that attend to the pre-assembly of the track fixing elements, and the means that install the pre-assembled sets of the elements, is rendered particularly advantageous and functional on account of the following.

First of all, intermediate elements have been chosen, constituted by the previously mentioned magazines 60, designed to house a plurality of pre-assembled elements and able to render the movement of the pre-assembled sets 55 particularly easy. Secondly, particularly efficient means of transportation have been chosen for the magazines 60 that are able to move, with precision and rapidity, both full and empty magazines from one part to another of the machine. Thirdly, a store of a particularly rational structure has been provided, at which terminate the means for transporting the magazines 60. All round this has resulted in the best possible use being made of the space available, the transfer operations being simplified and rendered completely automated, and the work times being cut.

In greater detail, the following is stated with specific reference to FIGS. 1 to 4 and 10 to 16.

The problem to be solved is how to transport the pre-assembled sets 55 from the exit of the rotary tables 18 to a store, with the sets kept in the orientation most suited to the use to which they are put, and the quantity of the sets that have to be supplied, maintained. The solution to this problem is provided by an element that is able to guide properly the pre-assembled sets and can be made without undue difficulty. The element is in the form of the previously mentioned magazine 60 which is able to contain, for example, fourteen pre-assembled sets 55, placed in alignment and restrained at the extremities by two springs of a suitable design.

The magazines 60, of a special conformation, can be made by cutting sections of greater length. Furthermore, in order to solve the problem, a provision has been made for two rotary tables 18 that rotate, as shown in FIG. 3, in opposite directions one to the other and supply magazines 60 in diametrically opposed positions one to the other, with respect to the rotary tables 18. The assymmetrical pre-assembled sets 55 are thus inserted in magazines 60 parallel with one another but housing differently oriented sets. It is also envisaged that the means for transporting the full magazines 60 from the rotary tables 18 to the store be doubled: each rotary table has individual transportation means. Furthermore, the store is subdivided into two halves, each of which supplied exclusively by one specific rotary table 18 and by corresponding means for transporting the magazines 60.

As is obvious, the presence of two separate halves, each of which is supplied with differently oriented pre-assembled sets 55, renders immediate the furnishing to the laying equipment of the pre-assembled sets, which as shown in FIG. 12 need differently oriented elements.

Figure 4:
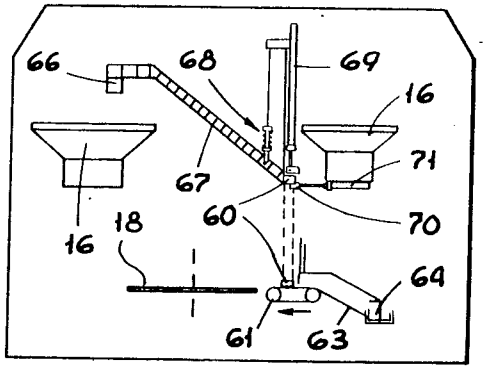
FIG. 4 is a cross section of FIG. 3.

The means for transporting the magazines 60 are shown in FIGS. 3, 4, 10 and 11 as regards the part thereof that attends to the transportation of full magazines 60 towards the two halves of the store, and in FIGS. 3 and 4 as regards the part thereof that has the task of transporting empty magazines 60 towards the expulsion means of the rotary tables 18. It is envisaged (FIG. 11) that when the final pre-assembled set 55 enters a magazine 60, a magazine full signal (effected with a unitary counter or feeler placed at the end of the magazine) be given, this stopping the cylinder 59 and setting in operation chain pushers 61 that move the magazine 60 onto a support surface 62 and then cause the magazine to fall in direction **62*a* (FIG. 3) along a sloping surface 63. The descent of the magazine 60 ends on a belt conveyor, shown at 64, also visible in FIGS. 3 and 4. The belt conveyor 64 moves forward (in direction 64*a*) in such a way as to insert the magazine in question onto rollers 65 (FIG. 3) where the displacement towards one of the halves of the store continues. Empty magazines coming from the half of the store move forward along a transportation line 66 (FIG. 3) and accumulate on a sloping surface 67 (FIG. 4) where they are restrained by a flexible stop 68 controlled by a gripper piston 69 which is able to grasp the magazines 60 one by one in order to place them in the position immediately adjacent to the table 58, as shown in FIGS. 10 and 11. In FIG. 4 it is also shown that at the end of the sloping surface 67 is placed a movable rest 70 that can be retracted under the action of a cylinder 71. The full magazines 60 flow from the rollers 65 to a further belt 72 (FIG. 3) that carries them into the region of the entrance to the store, shown globally at 73**.

The store 73 is shown in particular in FIGS. **13*a*, 13*b*, 14 and 15**.

Characteristics that are desirable in this store are: a capacity to contain a large number of pre-assembled sets in the way in which they have been previously arranged; an ability to charge full magazines and to discharge empty ones; the possibility of commencing the charging/discharging cycle at any moment; and, to conclude, the possibility of operating and controlling the store easily.

These characteristics are achieved, among other things, by subdividing the store 73 into a first half store 74 directly adjacent to the section of the machine 1 that attends to the pre-assembly of the fixing elements, and into a second half store 75 at the side of the former. Each half store 74 and 75 houses magazines 60 with pre-assembled sets 55 positioned in the same way, the sets in each half being positioned in an opposite way to those in the other half, as well as supplied by one specific rotary table 18, as shown.

Each individual half store 74 and 75 (FIGS. 14 and 15) effects one complete charging cycle in the same way, as described below.

Initially all the shelves in the store, shown at 76, as well as the lateral elevators 77 and 83, are filled with empty magazines 60. Upon the arrival of the first full magazine 60 at position 78, the elevator 77 starts to rotate, carrying the magazines downwards and having in position 78 one empty shelf. Contemporaneously, a translation or pusher member 79 withdraws a magazine from position 80 and moves it (in direction **81*a*) onto the surface 81 which is filled already with empty magazines in position 82, carrying one into position 82. At the same time an elevator 83 going round the extreme drums 83*b* and realized by a plurality of "T" horizontal supports 83*a* raises the empty magazine into position 82, while in the upper area of the elevator 83, a pusher member 84 removes the empty magazine, freeing the elevator and thrusting the empty magazine towards a rotary table 18 via element 67**. During this first phase all the remaining parts of the half store remain at a standstill.

Figure 16B:
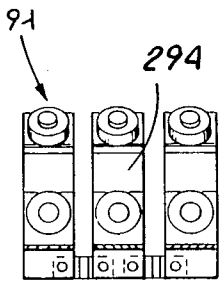
FIGS. 15 and 16 show in a lateral and in a plan view, respectively, additional store parts of the store together with the components connected thereto, FIG. 16*a* being a side view which is rotated by 90° with respect to the end view of FIG. 10*b;*
Figure 16A:
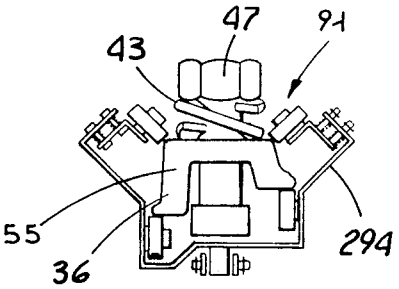
Figure 16:
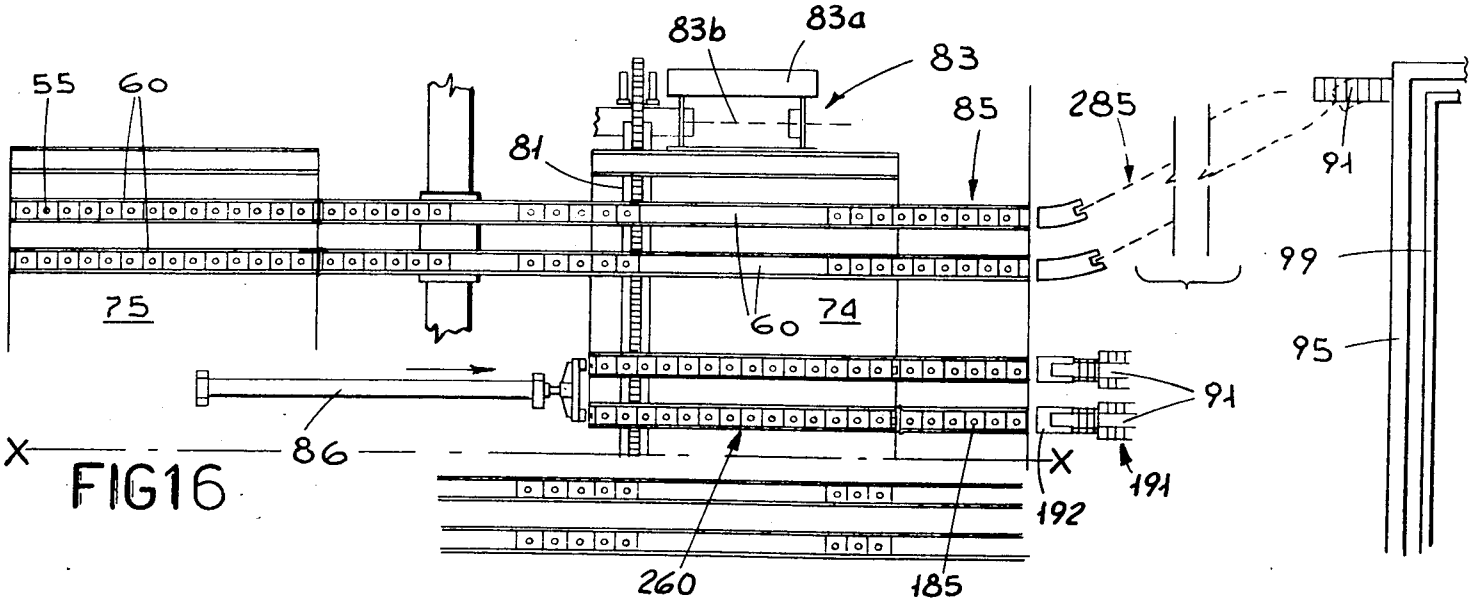

This first phase continues up to the filling with pre-assembled sets 55 of tracks 85 which, as will be seen, are part of the means that supply the laying equipment of the machine 1. FIG. 16 is a plan view of the stores 74–75, schematically showing a portion taken in the plane of the longitudinal axis X—X, to illustrate the configuration of the magazines 60, with regard to the connection tracks 85. The pusher members 86 feed the sets 55 from the magazine-store to the presenting means.

Figure 15:
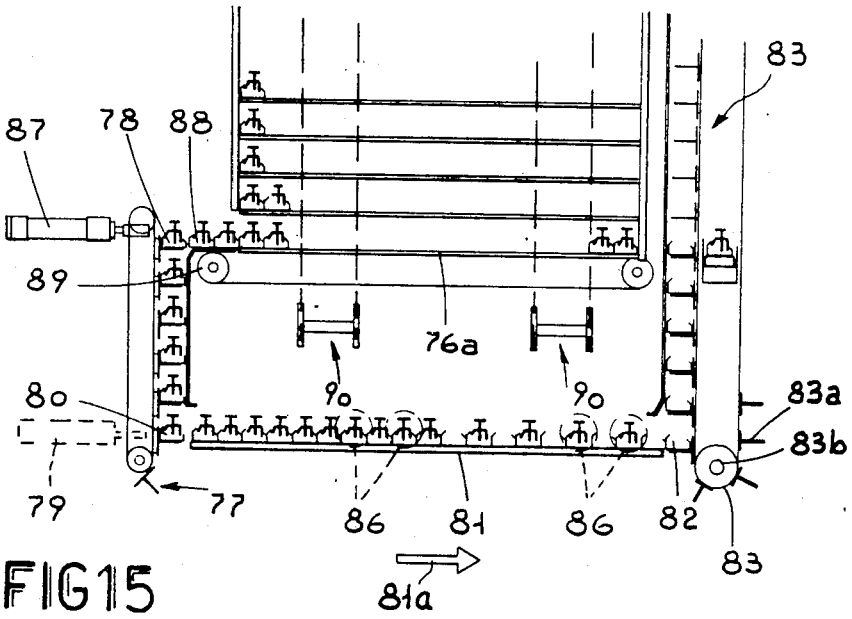
Figure 20:
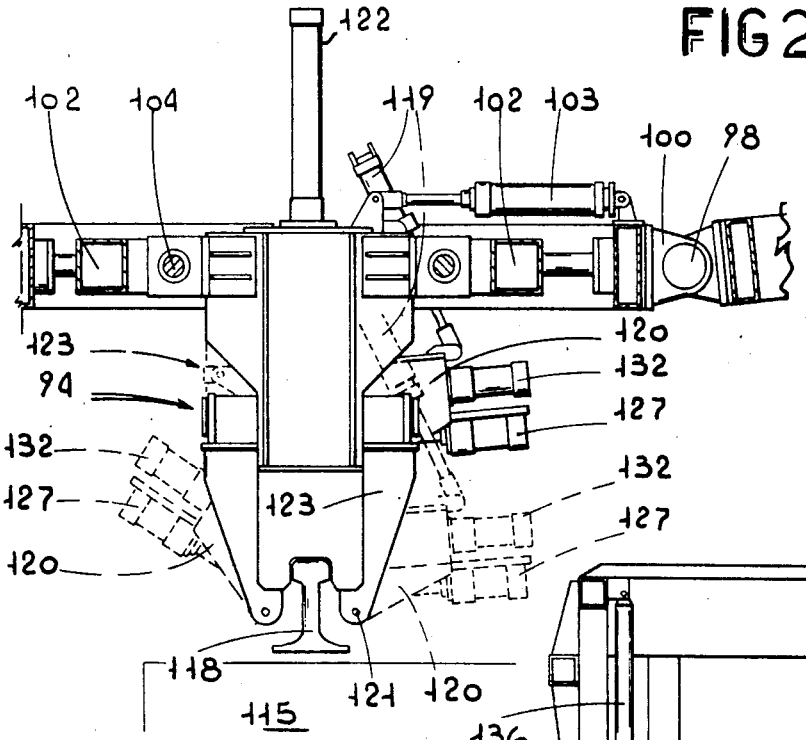

The reference numeral 83*a* indicates the "T" horizontal supports of the elevator 83 (see also FIG. 15). The axis 83*b* is the axis of the extreme drums of elevator 83. The filling of these tracks 85, effected advantageously in advance of the filling of the store 73, takes place (FIG. 16) by means of pusher members 86 that empty the various magazines 60 and discharge the pre-assembled sets 55 into the tracks 85. This operation ceases when a signalling device, for example constituted by a proximity reader or by a unitary counter, advises that the filling is complete.

During this first phase, the whole elevator 77 is charged with filled magazines and surface 81 too is loaded with filled magazines up as far as the pusher members 86. The signalling device that gives notice that filling is complete, causes the elevator 77, the pusher member 79 and the elevator 83 to come to a halt. Furthermore, the filling complete signal causes the remaining parts of the half store to be set in operation, thereby initiating the real storage cycle.

The store 74, during this second phase, has the shelf 76*a* situated level with the position 78 empty, and the upper shelf 76*b* in the high position, in the region of the empty magazine discharge area, filled with empty magazines. The same thing applies for the intermediate shelves 76. In practice, all shelving is made of lateral "T" sections linked to lifting chains, so as to create extremity rests for the magazines 60.

Proceeding with the filling cycle, upon the arrival of a full magazine in position 78, two pusher members 87 thrust the magazine in a crosswise direction towards the next position 88 in which there is already a full magazine. In practice, the magazine goes onto the previously mentioned shelf 76*a*, above a pusher member 89 which, at this stage, idles and only helps to decrease the friction of a sliding type of the magazines 60. The operation continues until the whole shelf 76*a* is full. When this is so, through the elevators 90 the shelf is lifted up one step so calculated as to present another shelf 76 empty and ready to be filled.

Figure 14:
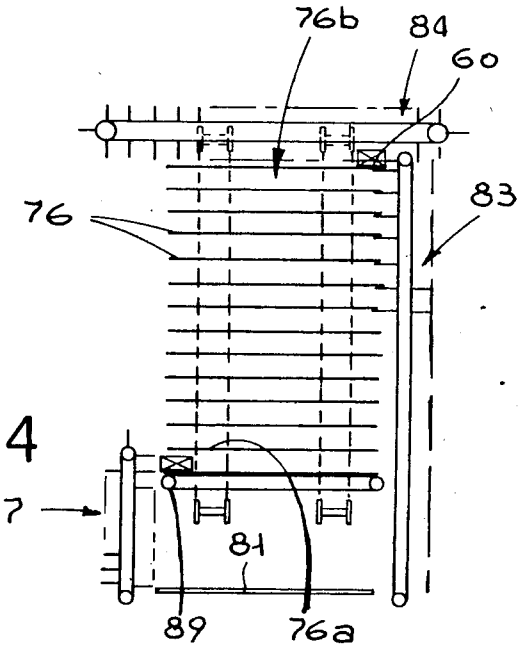
FIG. 14 shows the structure of one single part of the store.

Contemporaneously, on the last shelf 76*b*, in the uppermost position, as one full magazine enters, an empty one exits, thrust by the pusher member 84 (FIG. 14). The empty magazine made to move forward takes up, on the elevator 83, the waiting position from which a pusher member channels the magazine in question towards a rotary table 18 for the filling thereof to be effected. It is obviously necessary for the number of magazines in the charging phase to correspond numerically to the number of magazines in the discharging phase, in the sense that if the charging shelf is completely empty, the discharging shelf has to be completely full; similarly should the discharging shelf be partially full, the charging shelf has to be partially empty. This correspondence is achieved since in the work phase when a full magazine exits, in the region of the pusher member 89, an empty magazine is made to enter from the elevator 83.

This second phase continues until each half store 74 and 75 is filled completely with full magazines. The phase of filling the halves of the store can be effected at any moment, irrespectively of the quantity of full magazines still contained therein.

The real work phase of the store 73 is not the one just described, referred to the filling thereof, in correlation with the means for transporting the magazines 60 from and towards the rotary tables 18 but the phase performed in order to supply the pre-assembled sets 55 to the means that furnish the laying equipment of the machine 1. In the latter work phase, the whole store is in motion and the elevators 90 move in the reverse direction to that previously described and carry the shelves 76 downwards.

From an analysis of the individual movements, it can be seen that the supplying of the pre-assembled sets 55 from the store to the tracks 85 takes place under the impulse of the pusher members 86 which, in each half store 74 and 75, empty four magazines at a time.

When the pusher members 86 return to the non-operative condition, the translation members 79 of each half store 74 and 75 move forward four steps, four being the magazines emptied, and at each step a full magazine carried by the elevator 77 arrives on the surface 81 of the said translation members 79, while an empty magazine departs carried away by the elevator 83. Contemporaneously, the pusher member 89 carries, at the same rhythm, four full magazines onto the surfaces of the elevator 77, emptying a little at a time the corresponding shelf 76*a*. At the same time, the elevator 83 discharges onto the shelf 76*b*, again at the same rhythm, the four empty magazines.

This means that the supply to the laying equipment of the machine 1 are not limited to the tracks 85 and to the pusher members 86, placed closely in correlation with the store 73, but also comprise presenting means, described later on in relation to the laying equipment, and thrust groups 91 that can be seen in FIG. 1 and are shown in an isolated position in FIG. 17. The thrust groups 91 are substantially constituted in part by special profile chain sections for guaranteeing the forward movement of the groups, and in part by articulated sections designed to remedy any misalignment.

FIG. 17*b* is a side view of the thrust groups 91 which are disposed downstream the store 74, as also seen in FIG. 16 which groups we have indicated with 191. FIG. 17*a* is an enlarged view of part 194, taken from direction A of FIG. 17*b*. More particularly, as shown in the position 191 (FIG. 16), the thrust groups are in the same relative position that is illustrated in FIG. 17*b*, with a linear fixed portion 192 aligned relative to the store fixed guides 185. A moving portion 193 comprising a plurality of links 194 attached to a continuous chain 195, also indicated at 285 in FIG. 16. This arrangement enables the relative movement between the fixed store 74 and the movable bogie 95. In the corrected FIG. 17*a*, it is possible to see the shape of one link 194 with a pre-assembled set 55 therein. While in the portion 192, the sets 55 are pushed by the members 86 (FIG. 16). In the link 194, the sets 55

(a) run along the aligned links in response to the action of the pusher member 86, when the chain 195 is stopped during the empty period of the magazines 60, in the 260 position of FIG. 16; and (b) are contained in the links 194 when the chain 195 runs in order to feed the movable guide 107, during the period for exchanging the empty magazines 60 for full ones in the store 74. This is to assure a continuity in the feeding of the pre-assembled sets 55 to the laying equipment group 94.

In FIG. 16, the part 91 corresponds to a plurality of links 294, similar to links 194, which are disposed upstream of the movable guide 107, which are articulated on to each other and which are not movable in order to remedy any misalignment (see page 32 last line and page 33 first line). Therefore, links 294 act like the links 194 during the period (a).

The square brackets 294 of FIG. 16 are the same as the rounded brackets of FIG. 17*a*. The shape of the bracket in FIG. 16 reduces the size of the link 294 owing to the reduced space in the zone of movable guide 107.

The part of the machine 1 will now be described that installs the pre-assembled sets 55 supplied by the above mentioned means. When the part slots the sets 55 into the dovetail in the plates already fixed to the ties, the fact has to be taken into consideration that the plates do not have a rigorously foreseeable position. In fact, when the ties are laid the pitch precision thereof is not guaranteed. Furthermore, the play that is possible between the guide of the rail on the plate and the flange gives the tie the possibility of being rotated slightly with respect to the perpendicularity of the track.

It also has to be considered that the track and the ties have to be banked at curves where a difference in gage exists. Lastly, the plates can very in type depending on whether the ties are made of wood or cement.

All these factors of uncertainty have, up until now, been an objective obstacle to the realization of automatic laying equipment. These difficulties are particularly important when the fact is taken into consideration that a machine that has to effect automatic positioning of the fixing elements of the track must operate at the relatively high rhythm set overall by the track construction train. This gives rise not only to the need to effect positioning in a particularly efficient way but also the need to operate with the machine in constant motion since it is not thinkable that, at the relatively high speeds, a machine with dimensions in the order of size of a railroad car would be able to proceed in steps or inching because of the massive inertia that would be created and too long reaction times.

In practice, all the problems and technical difficulties that arise are solved through the provision of a plurality of laying groups or equipment selected numerically so as to allow each to have a reasonable amount of time in which to operate, despite the overall production rhythm being high, and of means for supporting the laying equipment, on one hand able to render the groups independent of one another, and on the other to separate the position of the groups from the overall position of the machine or railroad car that proceeds with constant, uniform, motion.

In other words, a technical solution has been devised according to which, while the machine considered globally proceeds at the speed required for a track construction train, the individual laying equipment groups proceed with reciprocating motion with respect to the machine and are secured to the rails during the actual laying phases. An original aspect is that in these movements, the laying equipment groups are, for example, controlled by proximity sensors that detect the exact position of the plates by making use of the fact that the plates are metal while the ties onto which they are fixed are made of wood or cement.

Thanks to the independence in movement of the various laying equipment groups, as well as to the reduced inertia thereof and to the precision with which they can be controlled by means of the sensors, the positioning of the pre-assembled sets formed of track bolts, clips, spring washers and nuts, can be effected with considerable precision and efficiency.

In order to describe in detail this part of the machine 1 that attends specifically to the fixing of the track, reference is made to FIG. 1 and to FIGS. 18 to 25. As FIGS. 1, 18 and 19 in particular show, it should be noted that the machine operates contemporaneously on two ties, one staggered with respect to the other, through four laying groups, each of which is shown at 94. Each one of the laying equipment groups 94 is mounted on one single bogie 95 that can be raised by means of four hydraulic cylinders 96 in such a way as to place the said bogie in a position retracted in the machine 1 when the work has ended. The hydraulic cylinders 96 are aligned vertically with the wheels 95*a* that rest directly on the rails. When the bogie is in the work position, it rests fully on the wheels 95*a*. So that it be possible to insert the bogie even with the machine 1 placed on a curve, two additional hydraulic cylinders are provided, one per side. Once the bogie 95 has been placed, the hydraulic cylinders or jacks 96 for lifting and the crosswise displacement hydraulic cylinders have to be taken out of operation, with the forward motion effected by means of a rudder 97 placed in a central position above the laying equipment groups 94. The rudder 97 is shown in FIG. 1.

Provided on the central axle of the bogie 95 is a guide shaft 98 on which are mounted supports 99 for the laying equipment groups 94. The supports 99 are mounted on the guide shaft 98 by means of pivots 100 such as to allow the supports 99 to be able to rotate in vertical planes so as to recover the difference in height between the rails at banks. Mounted on the supports 99 are guides 101 on which slides a second support 102 designed to make it possible for the laying equipment groups 94 to oscillate in a direction crosswise to the rails for inscription arc differences on bends and differences in gage. At the time the work commences, the second support 102 is controlled by pneumatic cylinders 103 which permit the wheels of the group 94 to be inserted exactly on the rails. During the work, the pneumatic cylinders 103 exert a slight pressure in order to keep the wheels 95*a* in contact with the head of the rails.

Mounted on the second supports 102 are guides 104 on which slides the main body of the laying groups 94, so as to give the latter a movement of oscillation parallel to the direction in which the track extends. This movement is precisely what is needed for the recovery of the forward movement space of the machine and the said recovery is effected by means of a recovery cylinder 105 which, at the end of the laying operation, carries the group 94 to a forward limit position, in the group charging area, where the cycle commencement signal is awaited. Both in FIG. 19 and in FIG. 1, the laying equipment groups 94 are shown in the furthermost retracted position.

As seen already in FIG. 17, means are provided for supplying the laying equipment groups 94 and, among other things, these comprise the said thrust groups 91. The said supply means terminate at the group 94 via presenting groups 106 that are shown in FIG. 1, and these, one per group 94, are destined to charge the said groups and are integral with the second supports 102, since the charging of the groups 94 always takes place in the same position, in the region of the front limit position, so as to always have fixed abutments.

FIG. 1 shows that at the exit of the thrust groups 91 is provided a movable guide section 107 that joins the thrust groups 91 to the presenting groups 106. This is in order to cancel out differences in alignment. The presenting groups 106 take possession of a pre-assembled set 55 from the movable guide 107 and carry the said set to the position in which this in the hold of the grippers of the laying group 94. Once the pre-assembled set 55 has been grasped by the said grippers, the presenting group goes back to the initial position and is ready for a fresh cycle. As shown in FIG. 1, the presenting groups 106 are provided with an arm 108 that rotates, in a vertical direction, around an extremity pin 109, and in a horizontal direction, around another pin 110. This is because, so as to avoid interference with the laying equipment, the presenting groups supply the pre-assembled sets 55 effecting first a downward movement, followed by a horizontal movement and then by the said pre-assembled sets being raised, by means of the said arm 108. The supplying operation takes place upon completion of the said displacements and the arm 108 returns immediately to the former position, in order to receive another pre-assembled set from the movable guides 107. Placed in between the latter and the arms 108 are selectors 111 for controlling the pre-assembled sets.

Reference is now made to FIGS. 20, 21, 22 and 22*a* which show the cycle of the laying equipment groups 94.

Figure 21:
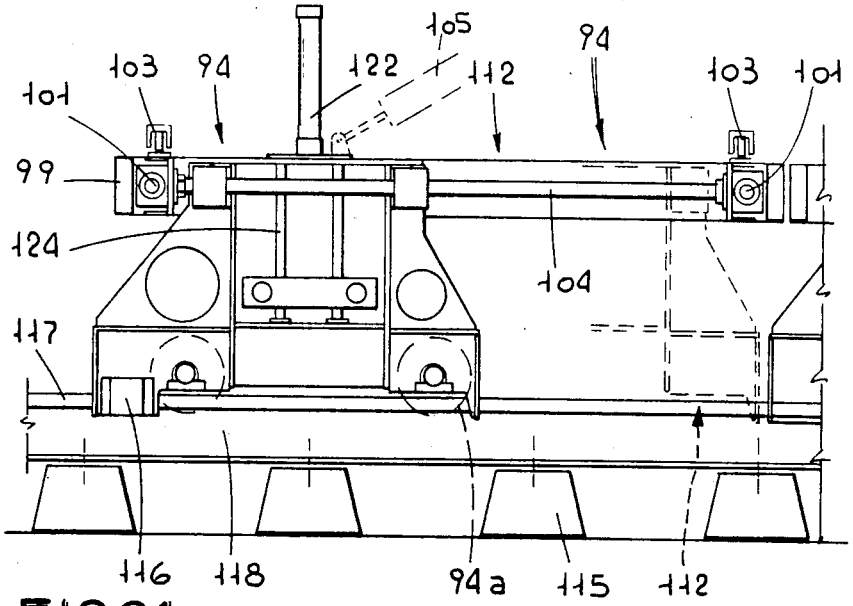
FIGS. 20 and 21 show the laying equipment of the pre-assembled sets, and the parts that directly support the laying equipment.

When the cycle is initiated, the laying group 94 is located in the displaced to the right position shown at 112 in FIG. 21. The said group has already a pre-assembled set 55 inside one of the grippers 113 thereof (shown in an isolated position in FIG. 22*a*).

The machine 1 moves forward and a proximity sensor detects when the laying group 94 is in the region of a plate 114 (FIG. 22) fixed onto a tie 115. The operation of the said proximity sensor (not illustrated and in itself known) causes the recovery cylinder 105 (FIG. 19) to cease operation and, at the same time, sets in action a vice 116 that locks onto the head 117 of one rail 118. This renders the group 94 integral with the rail 118, while the machine 1 continues to slide forward along the guides 104. Contemporaneously, a control cylinder 119 of the group 94 (FIGS. 20 and 22) moves into the closed position and obliges a support 120 carrying the grippers 113 to spiral downwards around a center of rotation 121. The vertical descent of the said support 120 also commences under the control of a vertical cylinder 122 that controls not only the support 120 but also a movable group 123 that sustains both the support 120 and the said cylinder 119, as shown in particular in FIGS. 20 and 22. The movable group 123 slides, as can be seen in FIG. 21, on vertical rods.

The descent comes to an end with the support 120 arranged in position at the side of a rail 118.

The vertical cylinder 122 preferably controls two movable groups 123 and, therefore, each rail 118 is flanked on opposite sides by two supports 120.

It should also be stated that the vertical descent controlled by the vertical cylinder 122 procedes, at least in part, the rotation phase of the support 120 under the control of the cylinder 119. The latter, in fact, effects the rotation of the support 120 that determines the definite insertion into the plate 114 of the pre-assembled set 55, as shown in FIG. 22.

Figure 22:
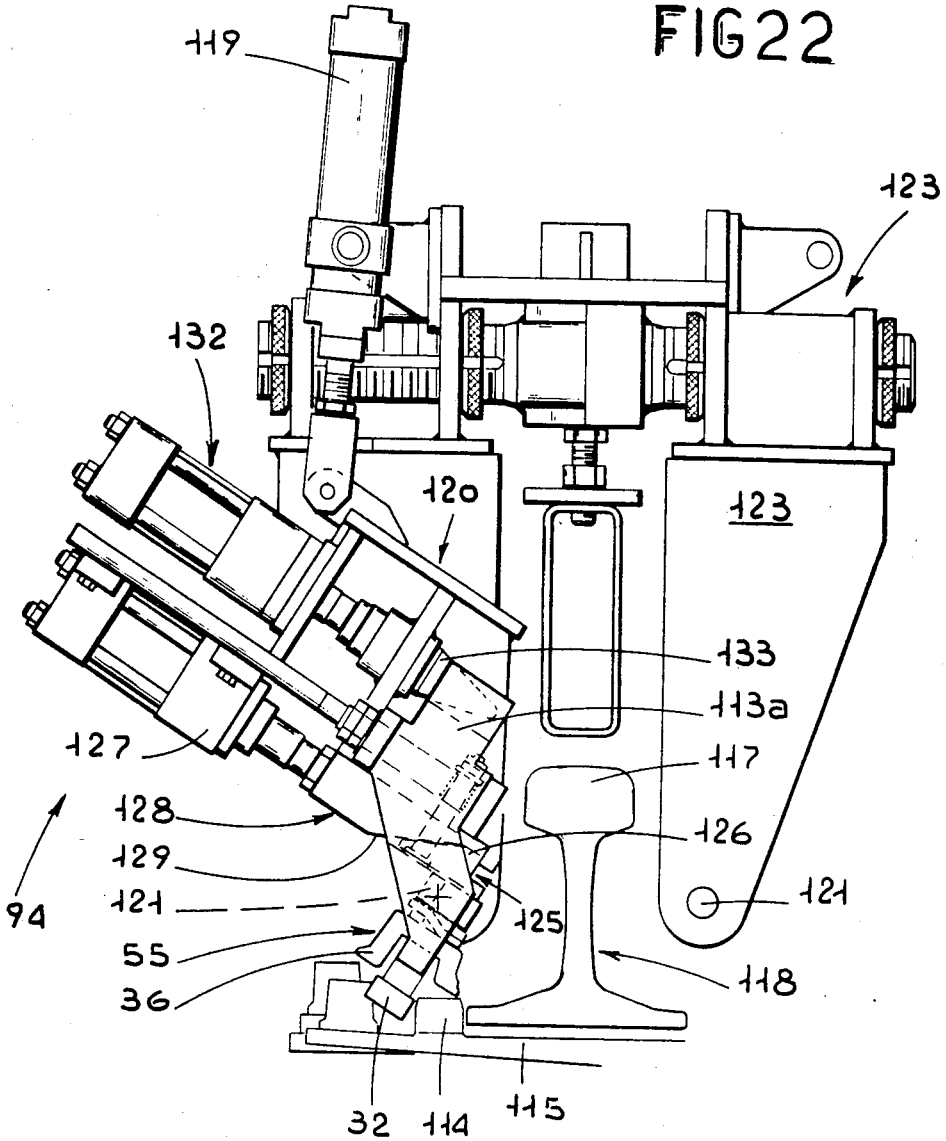
FIGS. 22 and 22*a* show, in detail, the structure of the laying equipment.
Figure 22A:
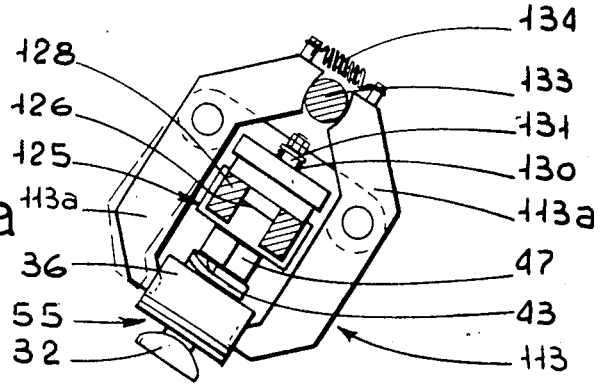

It can also be seen in FIGS. 22 and 22*a* that the insertion into the plate 114 of the pre-assembled set 55 takes place while the grippers 113 are closed and are holding, in a compression phase, the pre-assembled set 55. As shown in the said figures, the grippers 113 are, in fact, formed of two jaws 113*a* which support a pre-assembled set 55 grasped in the region of the clip 36 thereof and locked with the nut 47 in contrast with a block 125 provided with an oblique upper surface 126. On the latter is placed a paddle 128, also provided with an oblique surface 129, belonging to a presser cylinder 127. As a consequence of the operation of the presser cylinder 127, the paddle 128 moves forward obliging the block 125 to be lowered into the position shown in FIG. 22 that coincides with the maximum compression of the spring washer 43. The block 125 descends in contrast with elastic means 130 mounted around a rod 131 connecting the block 125 to the support 120.

FIGS. 22 and 22*a* also show that the jaws 113*a* of the grippers 113 are opened and closed by means of a cylinder 132 sustained by the support 120 and provided at the end of the rod thereof with a wedge 133 that is inserted in between the jaws 113*a*, in contrast with a tension spring 134 (FIG. 22*a*).

The technical solution of assembling the set 55 with the elastic washer in a state of compression makes easy and certain insertion of the track bolt 32 into the plate 114, with ample margins for any lack of precision in the positioning of the plate 114.

Once the pre-assembled set 55 is inserted, the cylinder 132 forces the wedge 133 in between the jaws 113*a*, causing them to fork. The support 120 can, therefore, be rotated and raised for a fresh insertion operation.

Just as soon as the grippers 113 are released from the pre-assembled set 55, the vice 116 is operated anew to cease the action of locking onto the rail 118 concerned, while the recovery cylinder 105 is set in operation to carry the laying group 94 along the guides 104 towards a position farther forward. Once the most distant limit position is reached, the presenting group 106 inserts a new pre-assembled set 55 into the grippers 113 which, in the meantime, have arrived in the maximum raised position. The movement for supplying the presenting group 106 has already been described.

Special studies have shown that all the phases for supplying the grippers 113, the rotation thereof and the insertion of a pre-assembled set 55 in a plate 114, can take place in a reduced amount of time compatible with the machine moving forward at a discrete speed and the length of the guides 104 not being particularly accentuated. Safety devices can, however, be provided that interrupt, in the event of any jamming consequently protracting the laying operation, one cycle and directly initiate the commencement of the subsequent cycle. It can happen that a pre-assembled set 55 is not inserted but this does not determine a concatenation of delays such as otherwise would lead to all the operations of the machine being thrown out of phase.

Thus all the operations connected with the setting in position of the pre-assembled sets 55 have been effected. The said sets, however, are not yet tight and remain positioned simply through the pressure of the spring washer 43, enclosed between the nut 47 that is fitted on very loosely and the track bolt 36.

The tightening of the nut 47 and, therefore, of the entire pre-assembled set 55 can only be effected after the gage of the rails 118 has been set.

Figure 24:
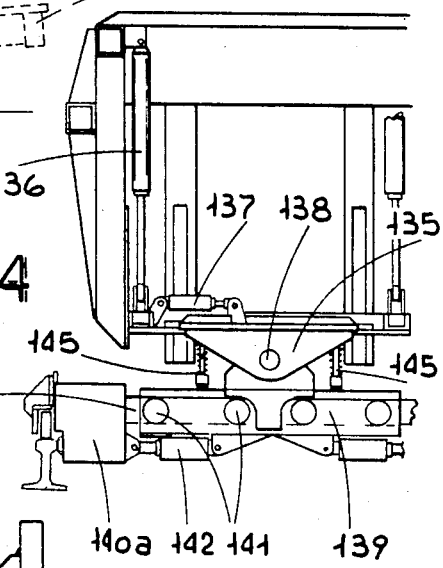
FIGS. 23 and 24 show how the grippers designed to define the exact gage of the track to be fixed, are constructed.
Figure 23:
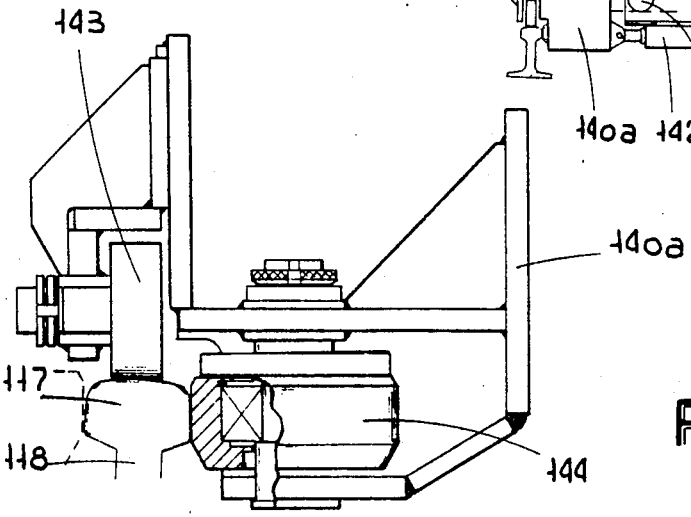

The machine 1 according to the invention is provided advantageously with a device that sets perfectly the gage of the track prior to the tightening of the already laid pre-assembled sets 55. The said device is shown in FIGS. 23 and 24 to which reference will now be made.

A main body 135 is provided that is movable both in a vertical direction, under the control of hydraulic cylinders 136, and in a horizontal direction, transversely to the track, under the control of a hydraulic cylinder 137. Upon commencement of the work, the main body 135 is lowered and inserted in between the rails.

At the time of insertion, the device is in a contracted position. The main body 135 supports, in fact, through an articulation 138, defining an axis of oscillation parallel to the rails, a beam 139 on which are telescopically mounted props 140 placed on opposite sides of the beam 139 and able to slide thereon by means of small wheels 141.

The props 140 are controlled in movement by expansion cylinders 142, one side of which fixed to the beam 139, and the other to an expansion of the prop 140. This expansion is a frame containing means for support and contrast on the head 117 of the rails 118, and is shown in FIG. 3 and at 140*a* in FIG. 24. It can be seen that in the expansion 140*a* of each prop 140 there is a small support wheel 143 that is placed on the head 117, and a pair of contrast wheels 144 that define the precise gage.

The work phases are as follows:

Once resting on the rails, the hydraulic cylinder 137 is taken out of operation, while in the vertical hydraulic cylinders 136 a slight pressure is left so as to prevent the device moving out of the rails.

At this juncture, the main body 135 is free to slide in a direction crosswise to the rails, on purposely provided wheels, while the expansion cylinders 142 open and carry the contrast wheels into the region of the required gage. Reaction due to the correction of the gage occurs between the two rails 118 and, therefore, does not stress the machine 1. The articulation 138 makes it possible to absorb any eventual banking differences, while elastic means 145, provided at the sides of the said articulation 138, enable the beam 139 to be kept centered during the upward and downward movement thereof.

The checking of the gage is displayed by electrical means which give, from one moment to another, the gage value required displayed on an indicator, so as to render the operation of altering the gage on a band, particularly easy. When the gage setting device is not being utilized, the previously mentioned hydraulic cylinders 136 attend to the raising thereof into the inside of the machine.

The final operation can now be carried out, that is to say the tightening of the nuts 47 in order to lock definitely the track. The said operation, shown in FIG. 25, is performed in the same way as previously described for the laying equipment 94. The tools used are the tightening devices 146 that are free to move in three orthogonal directions, like the laying groups. The greatest difference with respect to the latter lies in the fact that, in view of the simplicity and the rapidity of the work of the tightening devices 146, it is not necessary to operate on two separate ties 115 but on one only.

At the beginning of the operation, the machine moves forward and a non-illustrated proximity sensor detects the presence of a plate 114 and, through the action of a vice similar to that provided for the laying groups 94, locks the tightening devices. Contemporaneously a purposely provided recovery cylinder is discharged in order to allow the tigthening devices 146 to stay in position while the machine moves forward.

The said tightening devices are made to drop onto the pre-assembled sets 55 by means of a purposely provided vertical cylinder that carries the chuck 147 of the tightening devices into engaging with the nuts 47. In order to correct any eventual misalignment, a centering chamfer is provided in the chuck 147. The said chuck is provided with a pair of guides 149 and 150 that are crossed so as to make the articulation thereof possible. Undesirable detachment is prevented by the presence of rigid rubber enveloping means 151 that limit the maximum sliding movement of the guides 149 and 150.

In general, the tightening device can be of a type found on the market that determines the driving torque of the nut 47 according to the time of action thereon. Upon completion of the tightening operation, the devices 146 return upwards, controlled by the said cylinder, while the distance the machine has travelled in the meantime is recovered by means of a purposely provided recovery cylinder.

The cycle is now complete and the tightening device is ready to operate anew.

It is envisaged that the machine according to the invention be provided with a standby manual tightening device in order that it be possible to tighten nuts 47 that, for any reason whatsoever, have not been tightened.

Thus the invention attains the objects proposed.

Emphasis is laid on the completeness of the machine created, the ability of this to effect, in a precise and totally automatic fashion, the full sequence of operations outlined previously, with a maximum guarantee of reliability, and the fact that the said machine, although of ample overall dimensions, defines a volume comparable to that of one single railroad car.

Furthermore, the versatility is stressed of the machine created, which can be split into a number of parts should more limited automation be required.

It is envisaged that a track construction train equipped with the machine according to the invention can notably cut operating costs, as well as execute the work without dependence on the availability of labour.

Moreover, in a track construction train equipped with the machine according to the invention, the various component items of equipment can be improved in such a way as to raise the rate of production without the improvement being rendered nil by the need for a greater amount of labour to be provided for the fixing of the track. Also, the operations automated with the machine according to the invention are operations typical of workers who are unskilled and are, therefore, difficult to find at the present time.

What is claimed is:

1. A machine for positioning fixing elements on prior laid rails, said fixing element comprising track bolts, clips, spring washers and nuts which are used to lock the rails to pllates which are associated with ties, vibrator means for placing the fixing elements in predetermined positions, a rotary table having a plurality of assembly stations, guide means for directing each type of said fixing elements from charging areas along at least one specific routing path passed said vibrator means to said rotary table means having said plurality of assembly stations for pre-assembling said fixing elements into sets, magazine means which are able to house said pre-assembled sets in alignment therein, means for expelling said pre-assembled sets of said fixing elements toward said magazines for alignment therein, store means for containing a plurality of said magazines, laying equipment for affixing said pre-assembled sets to said plates, and means for supplying said pre-assembled sets from said store means to the laying equipment, support means for said laying equipment for enabling the laying equipment to undergo inching motion even when a car for transporting said machine is in constant movement on the rails; gripper means for defining the gage between the rails, said gripper means being downstream of the laying equipment, means downstream of said gripper means for tightening each of the pre-assembled sets, and means for transporting said magazines between said expulsion means of the said rotary tables and the said store means.

2. The machine according to claim 1 wherein said guide means for directing said fixing elements along one specific routing path comprise at least one conveyor belt mounted on a cantilever arm that can pivot from said machine, a plurality of hoppers separated one from the other by baffle plates, means for directing said fixing elements to said hoppers so that each hopper collects one of the fixing elements, additional conveyor belt means extending from said hoppers to the vibrator means, and guides interposed between the said vibrator means and said rotary tables.

3. The machine according to claim 2 wherein said baffle plates are interlocked with control means in the region of a free extremity of the conveyor belt on the cantilever arm, and each of said baffle plates being defined by a partition for directing the flow of said elements and pneumatic cylinder means for controlling said partition.

4. The machine according to claim 1 wherein there are twice as many vibrator means for said clips, as there are vibrator means for each of the other types of said fixing elements.

5. The machine according to claim 1 wherein the guide means, the vibrator means, and the rotary table means are all placed directly above a surface in the frame of the machine.

6. The machine according to claim 1 wherein there are two of said rotary tables, each of said rotary tables having a plurality of said assembly stations positioned in a way which is suitable for the expulsion of the said pre-assembled sets in opposite directions toward said two rotary tables.

7. The machine according to claim 1 wherein there are a plurality of said rotary tables, each of said tables having four of said assembly stations and one expulsion station comprising the means of expulsion, each of said assembly stations being designed to receive and position one type of the fixing elements.

8. The machine according to claim 7 and a third assembly station for inserting spring washers and a fourth assembly station for putting the nuts on the bolts, and an auxiliary station for stabilizing the position of said nuts screwed onto the bolts for only about two turns of a thread on the bolt.

9. The machine according to claim 7 wherein each rotary table has a sheet metal top on which grippers are positioned for locking the fixing elements, said locking grippers being movable in a direction which is radial with respect to said sheet metal top, and said locking grippers being movable with said top, said movement being between said stations.

10. The machine according to claim 9 and a pair of cams for controlling said locking grippers, one of said cams rotating with said sheet metal top at programmed intervals, microswitch means associated with said top for programming said rotation, a rotatable shaft associated with said machine, and means responsive to the rotation of said shaft for operating the second of the cams, the second of said cams directly controlling said locking grippers.

11. The machine according to claim 1 wherein said store means has two separate and distinct half-stores, each of said half-stores being supplied by one of said rotary tables and storing pre-assembled sets in a positional orientation, said positional orientation of pre-assembled sets in one of said half-stores being rotated through 180° with respect to the positional operation of pre-assembled sets housed in the other of said half-store.

12. The machine according to claim 11 wherein each of said half-stores comprises a pair of elevators placed on opposite sides of a set of superposed shelves which are movable in a vertical direction, translation means beneath said shelves, and pusher means located above the shelves.

13. The machine according to claim 12 wherein each of said half-stores contains the shelves which are defined by lateral "T" sections which are linked to lifting chains and which are able to support extremities of said magazines.

14. The machine according to claim 1 wherein said magazines are defined by sections partially in the shape of said pre-assembled sets, and springs associated with said sections for restraining the pre-assembled sets.

15. The machine according to claim 1 wherein said means for supplying said pre-assembled sets from said store means to said laying equipment comprise tracks for said pre-assembled sets, pusher means for emptying a pair of said magazines in order to insert the pre-assembled sets into said tracks, thrust group means for encouraging a forward movement of said pre-assembled sets along said tracks, and presenting group means fed by said tracks for directly supplying said pre-assembled sets of fixing elements to the laying equipment.

16. The machine according to claim 15 wherein said presenting group means comprise a rotating arm which is rotatable in a region of two pins, one of said two pins being perpendicular with respect to the other of said two pins, said two pins being able to receive said pre-assembled sets, control cylinders connected to the rotating arm to force the rotating arm to follow a path that has a first downward section, a second section of said path rotating the rotating arm toward the outside of the machine, and a third section of said path elevating the rotating arm around one of said two pins and extending as far as one of said laying equipment groups.

17. The machine according to claim 1 wherein there are four of said laying equipments, each of said laying equipments having two laying groups which are side-by-side and are symmetrical with respect to one rail, the action of said laying groups being contemporaneous on two supporting ties of said rails.

18. The machine according to claim 1 and a recovery cylinder, said means for supporting the laying equipment groups comprising a bogie on which said laying groups are movable under the control of said recovery clinder, said bogie moving along guides which are parallel to the rails, the laying groups having vices for locking onto the rails of the laying groups when the recovery cylinder is not in operation.

19. The machine according to claim 1 wherein said laying equipment comprises a pair of jaws forming a gripper which is able to tightly hold one of said pre-assembled sets in the region of said clip, and a presser cylinder means positioned inside said jaws to squeeze one of said pre-assembled sets with a spring washer between the clip and the nut.

20. The machine according to claim 19 wherein said jaws are mounted on a support which is rotatable in a plane which is crosswise with respect to the rails, and means by which said jaws can be raised vertically together with a movable group controlled by said vertical cylinder.

21. The machine according to claim 1 wherein said gripper means for defining the gage between the rails comprise a main body that can be positioned in a direction which is crosswise with respect to the rails, said gripper means supporting a beam which is perpendicular to the rails, means for articulating an axis of said beam to become parallel to the rails, telescoping props supported on said beam and being connected to contrast wheels resting directly on the inside of the rails, and expansion cylinders for controlling the positions of said props.

22. The machine according to claim 21 wherein said main body can be raised inside said machine.

23. The machine according to claim 1 wherein said tightening means have support means, and said tightening devices are aligned to operate on one single tie.

* * * * *